United States Patent [19]

Yastrebov

[11] Patent Number: 4,608,945

[45] Date of Patent: Sep. 2, 1986

[54] APPARATUS FOR RECIRCULATING BOILER FLUID

[75] Inventor: Andrei G. Yastrebov, Moscow, U.S.S.R.

[73] Assignee: Vsesojuzny Nauchno-Issledovatelsky Institut Atomnogo Energeticheskogo Mashinostroenia, Moscow, U.S.S.R.

[21] Appl. No.: 770,286

[22] PCT Filed: Nov. 26, 1984

[86] PCT No.: PCT/SU84/00065

§ 371 Date: Oct. 2, 1985

§ 102(e) Date: Oct. 2, 1985

[87] PCT Pub. No.: WO85/02667

PCT Pub. Date: Jun. 20, 1985

[30] Foreign Application Priority Data

Dec. 6, 1983 [SU] U.S.S.R. ..... 3669382

[51] Int. Cl.[4] ..... F22D 1/00; F22D 7/04

[52] U.S. Cl. ..... 122/407; 122/442

[58] Field of Search ..... 122/406 R, 406 S, 407, 122/414, 415, 442

[56] References Cited

U.S. PATENT DOCUMENTS

| | | | |
|---|---|---|---|
| 2,614,543 | 10/1952 | Hood | 122/407 |
| 3,101,699 | 8/1963 | Vorkauf . | |
| 3,411,485 | 11/1968 | Kraus . | |
| 3,478,726 | 11/1969 | Kikinis . | |
| 3,789,806 | 2/1974 | Gorzegno . | |
| 4,151,813 | 5/1979 | Gorzegno et al. | 122/407 |
| 4,183,331 | 1/1980 | Hull | 122/442 |

FOREIGN PATENT DOCUMENTS

| | | |
|---|---|---|
| 313316 | 2/1974 | Austria . |
| 0065408 | 11/1983 | European Pat. Off. . |
| 2740883 | 9/1979 | Fed. Rep. of Germany . |

*Primary Examiner*—Edward G. Favors

*Attorney, Agent, or Firm*—Fleit, Jacobson, Cohn & Price

[57] ABSTRACT

An apparatus comprises a separator (1) and a jet pump (2) with a feed valve (6) connected in parallel through a bypass pipeline (8). An axially movable hollow cylindrical member (14) having a movable nozzle (17) is installed in a static pressure chamber of the jet pump 2 and a fixed nozzle 19 is installed concentrically with the movable nozzle (17). Overflow openings (18) are provided in the walls of the hollow cylindrical member (14).

2 Claims, 2 Drawing Figures

APPARATUS FOR RECIRCULATING BOILER FLUID

FIELD OF THE ART

The invention relates to the manufacture of boilers for thermal power plants, and in particular, it deals with an apparatus for recirculating boiler fluid in thermal power plants in which it is necessary to increase flow rates or temperature of boiler fluid in various circulation circuits.

State of the Art

An apparatus for recirculating boiler fluid in once-through boilers is known (U.S. Pat. No. 3,411,485, Int. Cl.$^3$ F 22 B 35/10; US Cl. 122-407, published in 1968), in which, to increase the flow rate of fluid in the furnace screens of the boiler, use is made of a jet pump installed downstream the feed valve of the boiler. The apparatus also comprises a pipeline for recirculation of boiler fluid connecting a moisture separator to the suction pipe of the jet pump.

This apparatus for recirculating boiler fluid is, however, only operable in a narrow range of steam loads of the boiler since with such an arrangement of the feed valve and jet pump it is not possible to match the hydraulic characteristic of the boiler duct to the pressure characteristic of the jet pump.

For instance, if the jet pump having a high-pressure characteristic is used, the apparatus for recirculating fluid can only function under high boiler loads, and if the jet pump with a low-pressure characteristic is used, the recirculation apparatus will only function under start-up and low loads which is the field of application of this prior art apparatus.

An apparatus for recirculating boiler fluid is also known (U.S. Pat. No. 3,478,726, US Cl. 122-406, Int.Cl.$^3$ F 22 B 35/10, published in 1968), which is used in a oncethrough combined circulation boiler, comprising a controlled jet pump and a feed valve which are connected in series with a feedwater pipeline, and also a recirculation pipeline connecting a separatot to the jet pump. The jet pump has a chamber of static pressure in which is installed an axially movable hollow cylindrical member having one end secured to a movable rod and the other, free end provided with a nozzle. The recirculated fluid is fed from the separator through the recirculation pipeline to the interior of the cylindrical member, and feedwater, which is the working fluid of the pump, is fed into an annular space between the nozzle and the walls of the jet pump from an economizer. During axial displacement of the hollow cylindrical member, the cross-section of the annular space changes thereby ensuring a change in the flow of working fluid supplied to the mixing chamber of the jet pump to which the recirculated fluid is also supplied through the nozzle of the hollow cylindrical member. Then pressure is restored and velocities of fluids in the flow duct of the jet pump are equalized, and a mixture of the working and recirculated fluids is supplied therefrom to the furnace screens of the boiler.

In the known apparatus for recirculating boiler fluid, the jet pump is used as both pumping device and a feed valve of the boiler under normal operating conditions, and the feed valve proper is only actuated under emergency conditions or in case the pump fails.

The supply of working fluid effected as described above results in energy losses for eddy currents in the mixing chamber downstream the annular space, such losses occurring over the whole range of the boiler loads since there no means for controlling flow rate of feedwater under normal operating conditions other than the jet pump.

In addition, with the employment of this known apparatus high enough flow of recirculated fluid (with recirculation ratio of about 2–3) required at low boiler loads cannot be achieved since additional pressure losses occur if high flows pass through the nozzle orifice. All these factors result in a low efficiency of the apparatus for recirculating fluid in a once-through boiler.

SUMMARY OF THE INVENTION

The invention is based on the problem of providing an apparatus for recirculating boiler fluid having such a construction of a jet pump and its hollow cylindrical member and such a supply of working and recirculated fluids to the jet pump as to ensure an improved efficiency of the apparatus in operation by lowering additional energy losses for the formation of eddy currents in the annular space and also by eliminating restrictions for an increase in flow of recirculated fluid flowing through the nozzle under low boiler. loads.

This problem is solved by the fact that in an apparatus for recirculating boiler fluid, comprising a separator, a controlled jet pump and a feed valve which are connected to each other by a recirculation pipeline and a feedwater pipeline, the static pressure chamber of the jet pump accommodating an axially movable hollow cylindrical member having a nozzle, according to the invention, the jet pump is connected in parallel to the feed valve by a bypass pipeline, and the static pressure chamber of the jet pump is provided with a fixed nozzle which is installed concentrically with the nozzle of the hollow cylindrical member, the walls of the hollow cylindrical member having overflow openings through which the interior of the cylindrical member communicates with the interior of the static pressure chamber.

The static pressure chamber of the jet pump is preferably connected, via a portion of the bypass pipeline, to the feedwater pipeline at a point upstream the feed valve, and the recirculation pipeline is connected to the mixing chamber of the jet pump.

This construction of an apparatus for recirculating boiler fluid makes it possible to improve efficiency in operation of the recirculation circuit at various boiler loads with lower hydraulic losses because the installation of the jet pump in the bypass line in parallel with the feed valve allows the operation at high boiler loads to be ensured by a single nozzle only, i.e. by the static pressure chamber nozzle without moving the nozzle of the hollow cylindrical member.

When the nozzle of the hollow cylindrical member enters into the nozzle of the static pressure chamber nozzle, the cross-section of the annular space between the nozzles for the passage of working fluid changes so that flow of the feedwater changes respectively. In this case, the flow of working fluid is accompanied by lower eddy losses since only a part of the flow of working fluid passes through the annular space, the remaining part of the flow passing through the overflow openings and through the nozzle of the hollow cylindrical member substanially without hydraulic losses.

Concurrently with a change in the flow of feedwater, a change occurs in the type of the pressure characteristic: from the high-pressure one to the low-pressure one which provides for an increase in the ratio of circulation upon a decrease in the steam load on the boiler.

Upon complete closure of the nozzle of the static pressure chamber by the nozzle of the hollow cylindrical member, working fluid can only flow into the mixing chamber through the hollow member nozzle without additional hydraulic eddy losses.

In this apparatus, recirculated fluid is supplied from the separator to the mixing chamber of the jet pump so that recirculation fluid can be supplied substantially without additional pressure losses thereby providing for necessary, sufficiently high flows of the recirculated fluid at low boiler loads.

BRIEF DESCRIPTION OF THE DRAWINGS

These and other advantages of the invention will become clear from the following detailed description of an example of its realization with reference to the accompanying drawings, in which.

PREFERRED EMBODIMENT OF THE INVENTION

Figure 1:
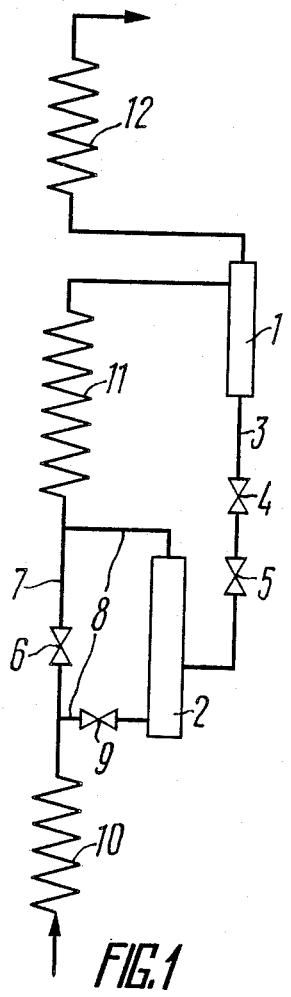
FIG. 1 is a functional diagram of an apparatus for recirculating boiler fluid according to the invention.

An apparatus for recirculating boiler fluid comprises a separator 1 (FIG. 1) which is designed for separating moisture for recirculation from a steam and water flow, a controlled jet pump 2 connected thereto by means of a recirculation pipeline 3 having a non-return valve 4 and a shut-off valve 5. The apparatus also has a feed valve 6 which is installed on a feedwater pipeline 7 and a bypass pipeline 8 connected to the feedwater pipeline 7 at a point upstream the feed valve 6 and at a point downstream thereof. A shut-off valve 9 is installed on the bypass pipeline 8. The shut-off valves 5 and 9 are provided for disconnecting the jet pump 2 if it fails.

The jet pump 2 is connected in parallel to the feed valve 6 by means of said bypass pipeline 8.

The apparatus for recirculating boiler fluid is connected in the integral circulation circuit of the boiler in combination with a economizer 10 which is connected through the feedwater pipeline 7 to an evaporator part 11 of the furnace screens of the boiler which is connected to the feed valve 6 and separator 1 of the apparatus. The separator 1 of the apparatus has a branch-off line for supplying dry steam to a reheater part 12 of the boiler.

Figure 2:
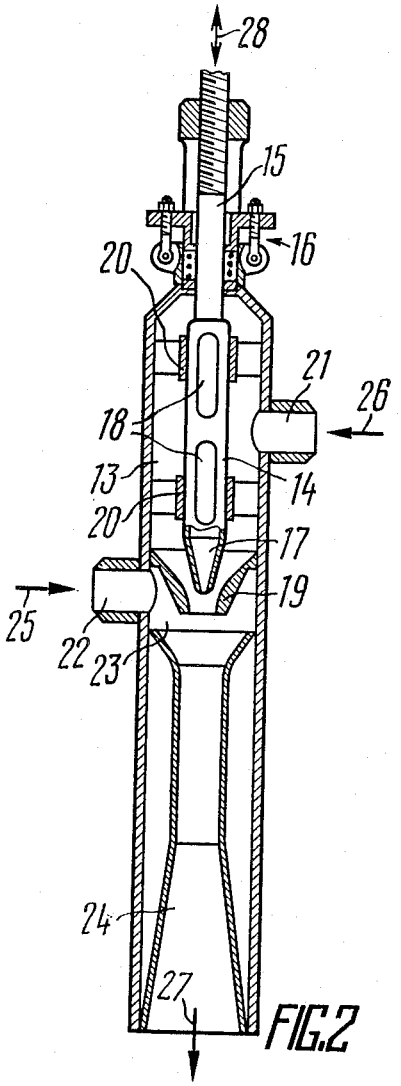
FIG. 2 is a jet pump (a longitudinal section view) of an apparatus according to the invention.

FIG. 2 shows a sectional view of the jet pump 2 having a static pressure chamber 13 which a accommodates an axially movable hollow cylindrical member 14 having one end thereof rigidly secured to a rod 15 connected to a servomotor (not shown in FIG. 2). The axial position of the rod 15 is ensured by a mounting member 16. A nozzle 17 (which hereinafter referred to as a movable nozzle 17) is secured to the free end of the hollow cylindrical member, and overflow openings 18 are provided in the walls of the hollow cylindrical member 14 for supplying feedwater to the interior of the movable nozzle 17.

The static pressure chamber of the jet pump 2 is provided with a fixed nozzle 19 secured to the walls thereof and installed concentrically with the movable nozzle 17 of the hollow cylindrical member 14. Bushings 20 are secured to the walls of the chamber 13 for supporting the hollow cylindrical member 14 to fix its axial position within the static pressure chamber 13. The jet pump 2 is provided with a pipe 26 for supplying working fluid from a portion of the feedwater pipeline 7 (FIG. 1) downstream the economizer 10, i.e. upstream the feed valve 6, via the bypass pipeline 8, to the static pressure chamber 13 (FIG. 2). In addition, the jet pump 2 has a pipe 22 for ssupplying recirculated fluid from the separator 1 (FIG. 1) through the recirculation pipeline 3 to the mixing chamber 23 (FIG. 2) connected to a diffuser 24 which connects the jet pump 2 (FIG. 1) to the portion of the feedwater pipeline 7 through the bypass pipeline 8 downstream the feed valve 6.

The apparatus functions as follows. Feedwater from the water economizer 10 flows through the feedwater pipeline 7 having the feed valve 6 and also through the bypass pipeline 8 having the open valve 9 through the jet pump into the evaporator part 11 of the furnace of the screens of the boiler. Excess moisture separated in the separator 1 is fed through the recirculation pipeline 3, non-return valve 4 and open shut-off valve 5 into the pipe 22 (FIG. 2) of the jet pump 2 (see arrow 25). At the same time, feedwater is admitted as working fluid of the jet pump 2 to the static pressure chamber 13 of the jet pump 2 through the pipe 21 (see arrow 21), which is connected to the bypass pipeline 8 (FIG. 1). Then working fluid flows from the chamber 13 (FIG. 2) through the fixed nozzle 19 into the mixing chamber 23 in which pressure of the fluid is lower than that in the separator 1 owing to the flow from the nozzle 19 so as to cause recirculated fluid to flow from the separator 1 through the pipe 22 to the mixing chamber 23 of the jet pump 2. The mixture of flows of recirculated and working fluids is admitted from the chamber 23 to the diffuser 24 where pressure of the fluids rises so that the mixture of working and recirculated fluids can now flow to the furnace screens 11 (FIG. 1) (see arrow 27) in which this mixture is admixed to feedwater flowing through the feedwater pipeline 7.

In this case the hollow cylindrical member 14 protrudes outside from the fixed nozzle 19, and the movable nozzle 17 does not cover the interior of the fixed nozzle 19 so that the flow of working fluid from the chamber 13 occurs without additional energy losses.

The abovedescribed process takes place at high steam generating capacities of boiler unit (about 60–100% of the rated capacity), the control of feedwater supply to the boiler being effected by the valve 6 only, and a non-controlled constant flow passes through the jet pump 2. Thus the jet pump 2 works in accordance with a high-pressure characteristic, i.e. recirculation fluid is pumped with low ratio of recirculation (of the order of about 0.2–0.6) to provide for a high degree of compensation for pressure difference at the fixed nozzle 19. At lower steam outputs (less than 60% of the rated capacity), the movable nozzle 17 moves into the interior of the fixed nozzle 19 concentrically therewith under the action of the rod 15. In this case working fluid from the chamber 13 is admitted through the overflow openings 18 to the interior of the hollow cylindrical member 14 having the movable nozzle 17. As the hollow cylindrical member 14 penetrates deeper, with its movable nozzle 17, into the interior of the fixed nozzle 19 (see arrow 28), the outlet orifice of the fixed nozzle is gradually closed, i.e. the cross-section of the annular space therebetween changes, whereby the flow of working fluid is controlled together with the flow of feedwater supplied to the boiler. The feed valve 6 is closed in this case (FIG. 1), and feedwater is supplied to the evaporator part 11 of the boiler through the bypass pipeline 8 and jet pump 2, the flow of feedwater is controlled only by the jet pump 2. It should be noted that as the movable nozzle 17 moves-in (FIG. 2), the delivery curve of the jet pump 2 changes from the high-pressure to low-pressure one thus bringing about an increase in the ratio of recirculation of boiler fluid from 0.2–0.6 up to 2.0–4.0 With the lowest output of the boiler (10–15%), the movable nozzle 17 will protrude at maximum possible depth into the interior of the fixed nozzle 19 to completely cover its outlet orifice, the working fluid being supplied to the mixing chamber only through the movable nozzle 17 which has a smaller cross-sectional area as compared to that of the nozzle 19. Therefore, the apparatus for recirculating boiler fluid operates within the steam output range between 60 and 100% of the rated capacity without additional eddy current losses since the flow of working fluid occurs through the fixed nozzle 19 without participation of the movable nozzle 17, whereas at low steam outputs of the boiler, when the movable nozzle 17 is drawn into the fixed nozzle 19, the eddy current formation can only take place in the part of the working fluid flow passing through the annular space between the walls of the nozzles 17 and 19 and there is no eddy current formation in the part of the flow passing through the nozzle 17, whereby additional losses through eddy current formation are lower as compared to the prior art apparatus. When the movable nozzle 17 completely covers the fixed nozzle 19, the flow of working fluid takes place without additional losses as there is no eddy current formation. Recirculated fluid in this apparatus is admitted directly to the mixing chamber 23, the area of contact between the flow of recirculated fluid and the flow of working fluid flowing from the nozzles 17 and 19 may be sufficiently large so as to avoid additional losses upon an increase in the flow of recirculated fluid, whereby there are no restrictions of flow of recirculated fluid as in the case of the prior art apparatus.

The abovedescribed advantages make it possible to ensure a substantial improvement of efficiency of operation of the apparatus for recirculating boiler fluid.

Use of the apparatus for recirculating boiler fluid makes it possible to enlarge the range of steam output of a once-through boiler from 60–100% to 15–100% of the rated capacity and lower start-up load at the once-through boiler from 30% to 10–15% of the rated capacity so as to ensure a substantial reduction of fuel, heat and feedwater comsumption for the start-up operation of a boiler unit.

Industrial Application

The apparatus for recirculating boiler fluid according to the invention may find application in once-through boiler units and also in drum boilers with multiple forced circulation for various industries, e.g. in transportation, shipbuilding and at industrial thermal power plants.

I claim:

1. An apparatus for recirculating boiler fluid, comprising a separator (1), a controlled water jet pump (2) connected thereto by a recirculation pipeline (3) and a feed valve (6) installed on a feedwater pipeline (7), a static pressure chamber (13) of the jet pump (2) accommodating an axially movable cylindrical member (14) having a movable nozzle (17), characterized in that the jet pump (2) is connected in parallel to the feed valve (6) and feedwater pipeline (7) by a bypass pipeline (8), and the static pressure chamber (13) of the jet pump (2) is provided with a fixed nozzle (19) mounted concentrically with the movable nozzle (17) of the hollow cylindrical member (14), overflow openings (18) being provided in the walls of the hollow cylindrical member through which the interior of the hollow cylindrical member (14) communicates with the interior of the static pressure chamber (13).

2. An apparatus according to claim 1, characterized in that the static pressure chamber (13) of the jet pump (2) is connected through a portion of the bypass pipeline (8) to the feedwater pipeline (7) at a point upstream the feed valve (6), and the recirculation pipeline (3) is connected to the mixing chamber (23) of the jet pump (2).

* * * * *